US008133297B2

(12) United States Patent
Mende et al.

(10) Patent No.: US 8,133,297 B2
(45) Date of Patent: Mar. 13, 2012

(54) METAL POWDER

(75) Inventors: Bernd Mende, Braunschweig (DE); Gerhard Gille, Goslar (DE); Ines Lamprecht, Seesen (DE)

(73) Assignee: H.C. Starck GmbH, Goslar (DE)

( * ) Notice: Subject to any disclaimer, the term of this patent is extended or adjusted under 35 U.S.C. 154(b) by 0 days.

(21) Appl. No.: 12/517,124

(22) PCT Filed: Nov. 28, 2007

(86) PCT No.: PCT/EP2007/062940

§ 371 (c)(1), (2), (4) Date: Jun. 11, 2009

(87) PCT Pub. No.: WO2008/065136

PCT Pub. Date: Jun. 5, 2008

(65) Prior Publication Data

US 2010/0061879 A1 Mar. 11, 2010

(30) Foreign Application Priority Data

Dec. 2, 2006 (DE) ..... 10 2006 057 004

(51) Int. Cl.
*B22F 1/00* (2006.01)
*B22F 3/00* (2006.01)

(52) U.S. Cl. ..... 75/255; 75/246

(58) Field of Classification Search ..... 75/255, 75/246

See application file for complete search history.

(56) References Cited

U.S. PATENT DOCUMENTS

| | | | |
|---|---|---|---|
| 5,102,454 | A | 4/1992 | Johnson et al. |
| 5,912,399 | A | 6/1999 | Yu et al. |
| 6,554,885 | B1 | 4/2003 | Mende et al. |
| 6,613,122 | B1 | 9/2003 | Bonneau et al. |

FOREIGN PATENT DOCUMENTS

| | | | |
|---|---|---|---|
| DE | 1936029 | | 3/1970 |
| EP | 0665301 | A1 | 8/1995 |
| GB | 419953 | | 11/1934 |
| GB | 1269407 | | 4/1972 |
| WO | WO-97/21844 | A1 | 6/1997 |
| WO | WO-99/59755 | A1 | 11/1999 |
| WO | WO-00/23631 | A1 | 4/2000 |
| WO | WO-03/083150 | A1 | 10/2003 |

*Primary Examiner* — Roy King
*Assistant Examiner* — Ngoclan Mai
(74) *Attorney, Agent, or Firm* — Connolly Bove Lodge & Hutz LLP

(57) ABSTRACT

The invention relates to novel pre-alloyed metal powders a method for production and use thereof.

9 Claims, 7 Drawing Sheets

X-ray diffraction pattern of the mechanical powder mixture from example 5.

| List of reflections |
|---|
| Fe; 00-006-0696; Iron, syn; Im3m |
| Mo; 00-042-1120; Im3m |
| Co; 00-005-0727; P63/mmc |
| Co; 00-015-0806; Fm3m |

X-ray diffraction pattern of the powder according to the invention from example 4.

Thermal dilatometric measurement of the sintering behavior of the mechanical powder mixture and the powder according to the invention.

Thermal dilatometric measurement of the sintering behavior of the mechanical powder mixture from example 5 as a function of the heating rate.

Thermal dilatometric measurement of the sintering behavior of the powder according to the invention from example 4 as a function of the heating rate.

Sintering behavior on repeated heating.

Behavior on repeated cooling.

Residual porosity of the sintered bodies produced from the mechanical powder mixture and from the powder according to the invention.

Mechanical powder mixture from example 5

Powder according to the invention from example 4

Hot hardnesses as a function of the temperature.

METAL POWDER

RELATED APPLICATIONS

This application is a national stage application (under 35 U.S.C. §371) of PCT/EP2007/062940, filed Nov. 28, 2007, which claims benefit of German application 102006057004.9, filed Dec. 2, 2006.

TECHNICAL FIELD

Alloy powders have many uses for producing shaped sintered bodies by a powder-metallurgical route. The main feature of powder metallurgy is that appropriate pulverulent alloy or metal powders are pressed and subsequently sintered at a sufficiently high temperature. This method has been introduced on an industrial scale for the production of complicated shaped parts which can otherwise be produced only with a large amount of complicated final machining or, as in the case of liquid-phase sintering, e.g. in the case of cemented hard materials or heavy metals, where no technological alternatives exist.

In general, the porosity decreases with increasing sintering temperature, i.e. the density of the sintered part approaches its theoretical value. For reasons of strength, the sintering temperature is therefore made as high as possible and the production of particular phases, compositions, etc., also requires appropriately high sintering temperatures and long sintering times. However, the hardness of the metallic matrix decreases again above an optimum temperature since coarsening of the microstructure occurs as a result of grain growth (Ostwald ripening). For these reasons, powders which achieve their theoretical density and formation of suitable phases even at very low sintering temperatures are advantageous for sintered bodies.

PRIOR ART

There are thus a number of proposals for producing metallic alloy powders by precipitation, sometimes in the presence of organic phases, and subsequent reduction (WO 97/21 844, U.S. Pat. No. 5,102,454, U.S. Pat. No. 5,912,399, WO 00/23 631).

It is an object of the invention to provide alloy powders, i.e. prealloyed metal powders, which contain at least the metals iron, cobalt and molybdenum and meet the abovementioned demands made of sintered materials.

It has been known for a long time that steels based on FeCoMo within particular composition ranges form, when appropriate heat treatment is carried out, the intermetallic compounds $(FeCo)_7MO_6$ which make very high hardnesses and strengths possible and for particular applications represent an alternative to steels which can be hardened by carbidic precipitates (Köster, W.: Mechanische und magnetische Ausscheidungshärtung der Eisen-Kobalt-Wolfram-und Eisen-Kobalt-Molybdänlegierungen, Archiv für das Eisenhüttenwesen, 1932, number 1/July, pp. 17-23). However, the production of such steels by melting of the components and casting under an inert atmosphere is complicated and has hitherto not become established in industrial practise.

Recently, there have been successful attempts to produce such FeCoMo steels by a powder-metallurgical route by mixing of the individual powders and to test their properties (Danninger, H. et al: Heat Treatment and Properties of precipitation hardened carbon-free PM Tool Steels, Powder Metallurgy Progress, Vol. 5 (2005), No. 2, pp. 92-103). A disadvantage here is that the formation of the intermetallic compounds requires a number of heat treatments at high temperatures and for a long time in order to achieve uniform diffusion of the metals into one another and allow subsequent formation and fine dispersion of these phases in the microstructure as carrier of the desired properties.

Successful commercialization depends on whether production of such sintered parts can be realized at justifiable costs. Very sinter-active powders which contain all components in homogeneous form with uniform microstructure and isotropic properties and avoid costly heat treatments would therefore represent a decisive advantage.

BRIEF DESCRIPTION OF THE INVENTION

In the case of powders known hitherto, a particular disadvantage is that they contain inhomogeneously distributed components and therefore require high temperatures to achieve homogenization of the components by diffusion. In addition, the sintering behavior is dependent on the heating rate (rapid heating requires higher final temperatures or longer hold times) and the sintered bodies achieve only unsatisfactory sintered densities, i.e. have a corresponding porosity.

It has surprisingly been found that in the presence of molybdenum in a hydrometallurgically produced FeCo matrix, even calcination in air forms mixed oxides such as $CoMoO_4$ and $FeMoO_4$ which can be converted in a subsequent reduction under hydrogen under moderate conditions into very fine and highly sinterable metal powders containing the Mo in dissolved, homogeneous form.

The FeCoMo alloy powders produced in this way surprisingly differ from the prior art in that their sintering behavior is virtually independent of the heating rate during sintering (FIG. 5) and significantly higher sintered densities and thus lower porosities than when mechanically mixed powders are used are achieved under comparable sintering conditions. Apart from the advantageous sintering behavior, appreciably higher hardnesses are also achieved (table 2).

The invention first provides a process for producing the prealloyed metal powders by mixing aqueous metal salt solutions with a precipitate, preferably a carboxylic acid solution, separation of the precipitation product from the mother liquor and reducing the precipitation product to the metal, with the precipitant advantageously being used in a superstoichiometric amount and as a concentrated aqueous solution. The metal salt solutions and/or the aqueous solution of the precipitant can additionally contain solid compounds in dispersed form. As precipitant, it is possible to use the aqueous solution or suspension of a carboxylic acid, a hydroxide, carbonate or basic carbonate.

The precipitant can be added to the metal salt solution, but it is advantageous to add the metal salt solution to the precipitant.

The precipitation product is preferably washed with water and dried after being separated off from the mother liquor.

The reduction of the precipitation product is preferably carried out in a hydrogen-containing atmosphere at temperatures in the range from 600° C. to 850° C. The reduction can be carried out in indirectly heated rotary tube furnaces or in tunnel kilns. Further possibilities for carrying out the reduction will be readily apparent to those skilled in the art, e.g. in multistage furnaces or in fluidized-bed furnaces. This is surprising since Mo oxides can be reduced by means of hydrogen to Mo metal powders having sufficiently low oxygen contents as are required for further powder-metallurgical processing and sintering only at reduction temperatures above 1000° C.

At these relatively high reduction temperatures, relatively severe grain enlargement which reduces the sintering activity inevitably occurs.

In a preferred embodiment of the invention, the moist or dried precipitation product is calcined at temperatures in the range from 250° C. to 600° C. in an oxygen-containing atmosphere prior to the reduction. The calcination firstly effects size reduction of the precipitation product comprising polycrystalline particles or agglomerates by decrepitation as a result of the gases liberated during decomposition (of the carboxylic acid radical), so that larger surface areas and shorter diffusion paths are available for the subsequent, diffusion-controlled gas-phase reaction (reduction) and an end product having a smaller particle size is obtained. Secondly, a prealloyed metal powder having a considerably reduced porosity is obtained. In the further processing of the precipitation product [(mixed) metal carboxylate salt] to produce the prealloyed metal powder, a considerable reduction in the volume of the particles occurs and leads to the formation of pores. As a result of the intermediate calcination step in an oxygen-containing atmosphere, the precipitation product is firstly converted into the (mixed) metal oxide and heat treated, so that predensification with healing of flaws and micropores takes place. Accordingly, only the volume shrinkage of the oxide to the metal has to be overcome in the subsequent reduction in a hydrogen-containing atmosphere. A stepwise volume shrinkage which occurs with structural stabilization of the intermediate product crystals is accordingly achieved by the intermediate calcination step.

Suitable precipitants are carboxylic acids, but also hydroxides, carbonates or basic carbonates, in particular of the alkali metals or alkaline earth metals, advantageously of sodium or potassium. These are, in particular, hydroxides of the alkali or alkaline earth metals, very particularly preferably sodium hydroxide or potassium hydroxide.

Suitable carboxylic acids are aliphatic or aromatic, saturated or unsaturated monocarboxylic or dicarboxylic acids, in particular those having from 1 to 8 carbon atoms. Owing to their reducing action, formic acid, oxalic acid, acrylic acid and crotonic acid are preferred, and particular preference is given to using formic acid and oxalic acid, very particularly preferably oxalic acid, because of their availability. The carboxylic acids can be used as precipitant in aqueous solution or suspension but also in pure form when the carboxylic acid is liquid.

An excess of reducing carboxylic acids prevents the formation of Fe(iii) ions which would lead to a reduction in the yield.

The carboxylic acid is preferably used in a 1.1- to 1.6-fold stoichiometric excess, based on the metals. Very particular preference is given to a 1.2-1.5-fold excess.

In a further preferred embodiment of the invention, a carboxylic acid solution is used in the form of a suspension containing undissolved carboxylic acid (in suspended form) as precipitant. The carboxylic acid suspension which is preferably used contains a depot of undissolved carboxylic acid from which carboxylic acid withdrawn from the solution by precipitation is replaced, so that a high concentration of carboxylic acid in the mother liquor is maintained during the entire precipitation reaction. The concentration of dissolved carboxylic acid in the mother liquor at the end of the precipitation reaction should still be at least 10% of the saturation concentration of the carboxylic acid in water, in particular 20% of the saturation concentration of the carboxylic acid in water. In this way, complete and largely uniform precipitation of the metal salts is ensured. The alloy composition of the prealloyed powders can thus be fixed by selection of the composition of the metal salt solution.

Other suitable precipitants are hydroxides, carbonates or basic carbonates. These are, in particular, hydroxides of the alkali metals or alkaline earth metals, advantageously sodium hydroxide or potassium hydroxide. These can be used in a manner analogous to carboxylic acids, including their use in the form of a solution or suspension as described above for the carboxylic acid.

Although the precipitant can be added to the metal salt solution, the solution or suspension of the precipitant is advantageously initially charged and the metal salt solution is added.

In a particularly preferred embodiment of the process of the invention, the metal salt solution is added gradually to the carboxylic acid suspension, in such a way that the content of dissolved carboxylic acid in the mother liquor during the introduction of the metal salt solution does not go below a value of 50% of the solubility of the carboxylic acid in water. The metal salt solution is very particularly preferably added gradually in such a way that the concentration of dissolved carboxylic acid does not go below 80% of the solubility in water until the suspended carboxylic acid has been dissolved. The rate of addition of the metal salt solution to the carboxylic acid suspension is thus such that the withdrawal of carboxylic acid from the mother liquor including the reduction in concentration by dilution by the water introduced with the metal salt solution is compensated by dissolution of undissolved, suspended carboxylic acid.

As metal salt for producing the metal salt solution, it is possible to use all water-soluble compounds. Preference is given to using the chlorides or sulfates of the metals, so that a metal chloride or metal sulfate solution is used in each case. It is also possible to use mixed chlorides and sulfates by, for example, using iron chloride and cobalt sulfate for preparing the metal salt solution. The concentration of the metal salt solution is preferably from about 1.6 to 2.8 mol of metal per liter.

The metal salt solution preferably has a content of from 20% by weight to 90% by weight of iron, based on the total metal content, and also the elements cobalt and molybdenum. The content of iron in the metal salt solution is particularly preferably in the range from 25% by weight to 85% by weight, very particularly preferably from >30% by weight to 70% by weight, in each case based on the total metal content.

The metal salt solutions more preferably contain up to 65% by weight of cobalt, based on the total metal content, advantageously from 5% by weight to 50% by weight, in particular from 10% by weight to 30% by weight. The molybdenum content of the metal salt solution is from 3% by weight to 60% by weight, preferably from 4% by weight to 50% by weight, in particular from 5% by weight to 40% by weight, particularly advantageously from 6% by weight to 35% by weight, from 9% by weight to 30% by weight, from 12% by weight to 20% by weight or from 14% by weight to 19% by weight.

As molybdenum salt, it is advantageous to use molybdenum dioxide $MoO_2$. Since $MoO_2$ is insoluble, it can, for example, be suspended in the metal salt solution. However, it can likewise be suspended in the solution or suspension of the precipitant to which the metal salt solution is preferably added as described above.

With regard to the precipitation of the metal salts, a concentrated carboxylic acid solution has the "activity 1", an only half-concentrated carboxylic acid solution has the "activity 0.5". Accordingly, the activity of the mother liquor should preferably not drop below 0.8 during the addition of the metal salt solution.

For example, the solubility of the preferred oxalic acid in water is about 1.1 mol per liter of water (room temperature), corresponding to 138 g of oxalic acid (with 2 mol of water of crystallization). According to the process which is preferred according to the invention, the oxalic acid should be initially charged as an aqueous suspension containing from 2.3 to 4.5 mol of oxalic acid per liter of water. This suspension contains from about 1.2 to 3.4 mol of undissolved oxalic acid per liter of water. After introduction of the metal salt solution and completed precipitation, the content of oxalic acid in the mother liquor should still be from 15 to 30 g/l. During the introduction of the metal salt solution into the oxalic acid suspension, the oxalic acid consumed by the precipitation is continually replaced by dissolution of suspended oxalic acid. To homogenize the mother liquor, it is stirred continually. In a preferred embodiment, the metal salt solution is added gradually in such a way that the oxalic acid concentration in the mother liquor does not drop below 69 g, particularly preferably not below 110 g, per liter of mother liquor during the addition. In this way, a sufficiently high supersaturation which is sufficient for nucleation, i.e. production of further precipitate particles, is continually achieved during the addition of the metal salt solution. As a result, a high nucleation rate which correspondingly leads only to small particles is ensured and, secondly, agglomeration of the particles by partial dissolution is largely prevented due to the low metal ion concentration present in the mother liquor.

The high carboxylic acid concentration during the precipitation which is preferred according to the invention also results in the precipitation product having largely the same composition in terms of the relative contents of metals as the metal salt solution, i.e. a precipitation product and thus alloy metal powder which are homogeneous in respect of the composition formed.

The invention also provides prealloyed metal powders which contain the elements iron, cobalt and molybdenum and advantageously have an average particle size in accordance with ASTM B330 (FSSS) of less than 8 μm, advantageously from 0.1 μm to 8 μm, in particular from 0.5 μm to 3 μm.

The BET surface area of the prealloyed powders is generally greater than 0.5 $m^2/g$, advantageously from 0.7 $m^2/g$ to 5 $m^2/g$, in particular from 1 $m^2/g$ to 3 $m^2/g$.

The alloy powders contain from 20% by weight to 90% by weight of iron, preferably from 25% by weight to 85% by weight and particularly preferably from 30% by weight to 70% by weight of iron, based on the total metal content. The prealloyed metal powders more preferably contain up to 65% by weight of Co, advantageously from 5% by weight to 50% by weight, in particular from 10% by weight to 30% by weight. The molybdenum content of the metal powders is from 3% by weight to 60% by weight, preferably from 4% by weight to 50% by weight, in particular from 5% by weight to 40% by weight, particularly advantageously from 6 or 7% by weight to 35% by weight, from 9% by weight to 30% by weight, from 12% by weight to 20% by weight or from 14% by weight to 19% by weight. Further constituents of the alloy powders can be unavoidable impurities.

The present invention therefore also provides alloy powders containing from 20% by weight to 90% by weight of iron,
up to 65% by weight of cobalt,
from 3% by weight to 60% by weight of molybdenum;
or
from 20% by weight to 90% by weight of iron,
up to 65% by weight of cobalt,
from 9% by weight to 30% by weight of molybdenum;
or
from 20% by weight to 90% by weight of iron,
up to 65% by weight of cobalt,
from 12% by weight to 20% by weight of molybdenum;
or
from 20% by weight to 90% by weight of iron,
up to 65% by weight of cobalt,
from 14% by weight to 19% by weight of molybdenum.

Advantageous alloy powders contain from 25% by weight to 85% by weight of iron,
from 5% by weight to 50% by weight of cobalt,
from 4% by weight to 50% by weight of molybdenum;
or
from 25% by weight to 85% by weight of iron,
from 5% by weight to 50% by weight of cobalt,
from 9% by weight to 30% by weight of molybdenum;
or
from 25% by weight to 85% by weight of iron,
from 5% by weight to 50% by weight of cobalt,
from 12% by weight to 20% by weight of molybdenum;
or
from 25% by weight to 85% by weight of iron,
from 5% by weight to 50% by weight of cobalt,
from 14% by weight to 19% by weight of molybdenum.

Particularly advantageous alloy powders contain from 30% by weight to 70% by weight of iron,
from 10% by weight to 30% by weight of cobalt,
from 6% by weight to 35% by weight of molybdenum;
or
from 30% by weight to 70% by weight of iron,
from 10% by weight to 30% by weight of cobalt,
from 9% by weight to 30% by weight of molybdenum;
or
from 30% by weight to 70% by weight of iron,
from 10% by weight to 30% by weight of cobalt,
from 12% by weight to 20% by weight of molybdenum;
or
from 30% by weight to 70% by weight of iron,
from 10% by weight to 30% by weight of cobalt,
from 14% by weight to 19% by weight of molybdenum.

Very particularly advantageous alloy powders contain from 45% by weight to 70% by weight of iron,
from 16% by weight to 26% by weight of cobalt,
from 10% by weight to 38% by weight of molybdenum;
or
from 45% by weight to 60% by weight of iron,
from 20% by weight to 26% by weight of cobalt,
from 15% by weight to 25% by weight of molybdenum.

In addition, alloy powders in which the molybdenum content is less than 25% by weight when the iron content is greater than 50% by weight; and/or alloy powders in which the cobalt content is from 10% by weight to 30% by weight when the sum of the molybdenum content and the iron content is less than 90% by weight are very particularly advantageous.

The remaining components of the alloy powder are advantageously unavoidable impurities.

Alloy powders having the compositions shown in table 1 are especially advantageous.

TABLE 1

Table 1: Advantageous compositions of the prealloyed metal powders according to the invention

| No. | Iron content % by weight | Cobalt content % by weight | Molybdenum content % by weight |
|---|---|---|---|
| 1.001 | 45 | 17 | 38 |
| 1.002 | 50 | 25 | 25 |
| 1.003 | 60 | 25 | 15 |
| 1.004 | 70 | 18 | 12 |

The X-ray diffraction patterns of the prealloyed powders according to the invention differ significantly from those of powders which have been produced purely by mechanical mixing of element powders. The molybdenum reflection at 2Theta=40.5° (CuKα radiation) is advantageously absent. The X-ray diffraction pattern advantageously has a reflection for $(FeCo)_7Mo_6$ at 2Theta=37.5°.

After sintering, the prealloyed metal powders of the invention achieve a higher hardness than metallic powder mixtures of the same chemical composition (see table 2). The sintered bodies obtained from the prealloyed metal powder have densities of at least 97%, advantageously greater than 98.5% but in particular greater than 99%, of the theoretical density. These values can be achieved only rarely in powder-metallurgical processes. The shaped articles obtained by sintering of the prealloyed powder have high Rockwell hardnesses of greater than 50 HRC, in particular greater than 55 HRC and very particularly preferably greater than 60 HRC, straight after sintering. Depending on subsequent heat treatments ("tempering"), high Rockwell hardnesses, in particular, of generally greater than 60 HRC are achieved. Owing to the high sintered density which can be achieved, they can be sintered to close to final dimensions so that no or only little further machining is required. The prealloyed metal powders of the invention are characterized in that they have no fracture surfaces produced by milling. They can be obtained with this particle size directly after reduction, i.e. the fineness of the primary particles is achieved by means of the chemical process by which they are produced and not by mechanical processes such as milling, sifting, sieving, etc. The metal powders which have been prealloyed according to the invention have a low carbon content of less than 0.04% by weight, preferably less than 0.02% by weight and very particularly preferably less than 0.005% by weight. This can be attributed to the heat treatment in an oxygen-containing atmosphere which is carried out between precipitation and reduction and in which the organic carbon present after precipitation is removed. Preferred prealloyed metal powders also have an oxygen content of less than 1% by weight.

However, the composition of the powders of the invention is not restricted to the elements iron, cobalt and molybdenum. Even though the alloy powders of the invention advantageously contain only these metals and unavoidable impurities, it is possible for further metals M selected from the group consisting of tungsten, copper, nickel, vanadium, titanium, tantalum, niobium, manganese and aluminum to be present. Tungsten or copper can advantageously be present in amounts of up to 25% by weight each. Copper is advantageously present in amounts of up to 10% by weight, in particular from 6.5 to 10% by weight. Nickel, too, can be present in amounts of up to 10% by weight, advantageously from 1% by weight to 10% by weight, in particular from 6.5 to 10% by weight, but the alloy powder of the invention particularly advantageously does not contain any nickel, apart from unavoidable impurities. Further constituents of the alloy powders can be unavoidable impurities.

Furthermore, the alloy powder of the invention can contain vanadium, titanium, tantalum, niobium, manganese and aluminum. These additives are advantageously present in an amount of not more than 3% by weight each, in particular from 0.5% by weight to 3% by weight each. In this way, it is possible to set mechanical, thermal or electrical properties in a targeted manner. However, the alloy powder is advantageously free of metals M selected from the group consisting of vanadium, titanium, tantalum, niobium, manganese and aluminum. The remaining components of the alloy powder are advantageously unavoidable impurities.

The prealloyed metal powders are highly suitable for use in the powder-metallurgical production of components. The invention therefore also provides shaped articles which can be obtained by sintering a prealloyed metal powder according to the invention. These shaped articles are suitable for applications which require highly heat resistant components (mechanical stress at a long-term temperature of greater than 500° C.) and are characterized by a high hot hardness (even at temperatures above 600° C.), high creep strength, good thermal conduction and good chemical corrosion resistance. These shaped articles are therefore particularly suitable as cutting tools for austenitic steels or for parts of internal combustion engines, turbines, turbochargers, jet engines and the like.

BRIEF DESCRIPTION OF THE DRAWINGS

The figures illustrate the properties of the alloy powders according to the present invention.

WAY(S) OF PERFORMING THE INVENTION

Figure 1:
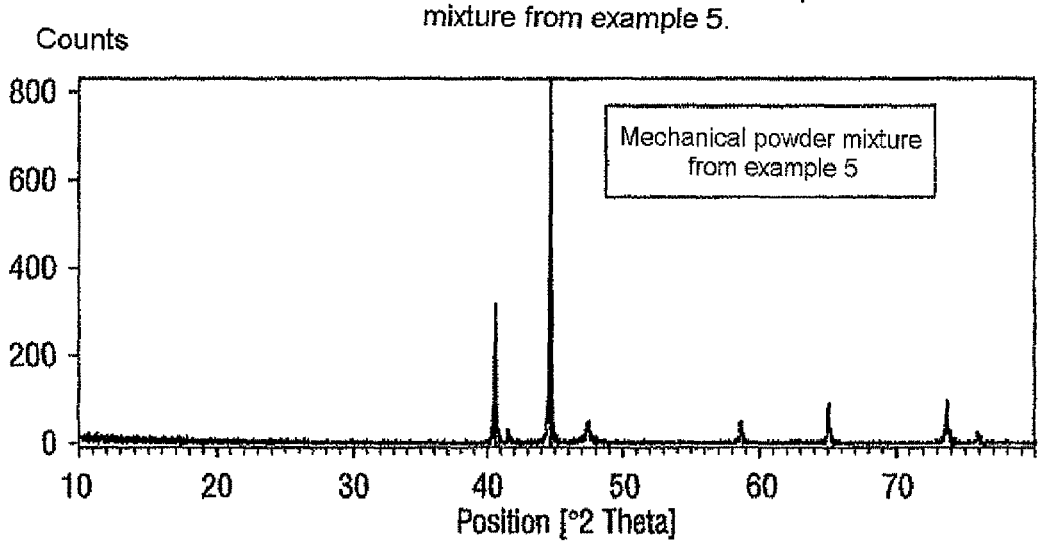
FIG. 1 shows an X-ray diffraction pattern of the mechanical powder mixture from example 5.

The invention is illustrated below with the aid of examples.

Example 1

90 l of deionized water were placed in a stirred vessel and, while stirring continually, 33.95 kg of iron(II) chloride with 4 mol of water of crystallization ($FeCl_2*4H_2O$) and 17.82 kg of cobalt(II) sulfate with 7 mol of water of crystallization ($CoSO_4*7H_2O$) were dissolved therein and homogenized. In parallel thereto, 114 l of deionized water were placed in a second stirred vessel and 32.51 kg of oxalic water with 2 mol of water of crystallization {$(COOH)_2*2H_2O$} and 3 kg of molybdenum dioxide ($MoO_2$) were dissolved or dispersed therein and homogenized with vigorous stirring. The FeCo mixed salt solution was subsequently pumped by means of a metering pump at a volume flow of about 2 l/min into the initial charge of oxalic acid and molybdenum dioxide. After precipitation was complete, the precipitation suspension was stirred for a further 30 minutes to establish equilibrium and was subsequently filtered through a suction filter to separate off the precipitate from the mother liquor and washed free of chloride and sulfate ions with deionized water.

The filter-moist precipitation product was calcined at about 550° C. in a countercurrent of air in a tunnel kiln and reduced to the metal powder at 750° C. in a hydrogen atmosphere in a subsequent tunnel kiln. Analysis gave the following values: 58.38% by weight of Fe/24.65% by weight of Co/15.27% by weight of Mo/0.63% by weight of oxygen. The carbon content was 17 ppm. The particle size measured by FSSS (ASTM B 330) was found to be 0.85 μm and the specific surface area (ASTM D 4567) was measured as 1.46 $m^2/g$.

Example 2

93 l of deionized water were placed in a stirred vessel and, while stirring continually, 32.79 kg of iron(II) chloride with 2 mol of water of crystallization ($FeCl_2*2H_2O$) and 12.83 kg of cobalt(II) sulfate with 7 mol of water of crystallization ($CoSO_4*7H_2O$) were dissolved therein and homogenized. In parallel thereto, 120 l of deionized water were placed in a second stirred vessel and 34.29 kg of oxalic acid with 2 mol of water of crystallization {$(COOH)_2*2H_2O$} and 2.40 kg of molybdenum dioxide were dissolved or dispersed therein and homogenized. The FeCo mixed salt solution was subsequently pumped by means of a metering pump at a volume flow of about 2 l/min into the initial charge of oxalic acid and molybdenum dioxide. After precipitation was complete, the precipitation suspension was stirred for a further 30 minutes to establish equilibrium, then filtered through a suction filter to separate off the precipitate from the mother liquor and washed free of chloride and sulfate ions with deionized water.

The filter-moist precipitation product was calcined at about 550° C. in a countercurrent of air in a tunnel kiln and reduced to the metal powder at 750° C. in a hydrogen atmosphere in a subsequent tunnel kiln. Analysis gave the following values: 69.11% by weight of Fe/17.73% by weight of Co/12.21% by weight of Mo/0.46% by weight of oxygen. The carbon content was 21 ppm. The particle size measured by FSSS (ASTM B 330) was found to be 0.97 μm and the specific surface area (ASTM D 4567) was 1.08 $m^2/g$.

Example 3

20.8 l of deionized water were placed in a stirred vessel and, while stirring continually, 5.91 kg of Fe(II) chloride ($FeCl_2*2H_2O$), 2.33 kg of Co(II) sulfate ($CoSO_4*7H_2O$) and 1.09 kg of Cu sulfate ($CuSO_4*5H_2O$) were dissolved therein. 436 g of molybdenum oxide were homogeneously dispersed in the clear solution with vigorous stirring. In parallel thereto, 23.9 l of deionized water were placed in a second stirred vessel and 6.83 kg of oxalic acid {$(COOH)_2*2H_2O$} were dissolved or suspended therein. The FeCoCu mixed salt solution with the dispersed $MoO_2$ was subsequently pumped by means of a metering pump into the initial charge of oxalic acid. After the precipitation was complete, the precipitation suspension was stirred for a further 30 minutes, then filtered through a suction filter and washed free of chloride and sulfate ions with deionized water.

The filter-moist precipitation product was calcined at 550° C. in the presence of air in a box furnace and reduced to the metal powder at 725° C. in an $H_2$ atmosphere in a second box furnace.

Analysis gave the following values: 61.57% by weight of Fe/16.34% by weight of Co/11.30% by weight of Mo/9.98% by weight of Cu/0.647% by weight of oxygen. The carbon content was 14 ppm. The particle size (ASTM B 330) was measured as 1.35 μm and the specific surface area (ASTM D 4567) was measured as 1.41 $m^2/g$.

Example 4

A metal powder having the composition 58.02% by weight of Fe/24.64% by weight of Co/15.03% by weight of Mo/0.774% by weight of oxygen and a residual content of 26 ppm of carbon was produced using the method and conditions of example 1. The particle size was found to be 0.67 μm and the specific surface area was found to be 2.15 $m^2/g$. This prealloyed powder will hereinafter be referred to as "powder according to the invention".

Comparative Example 5

To compare the properties, a mechanical powder mixture having substantially the same composition was produced from the individual powders of the participating elements. For this purpose, 1800 g of carbonyl iron powder from BASF (5-9 μm), 750 g of cobalt metal powder from Umicore, grade SMS (0.9 μm) and 450 g of molybdenum metal powder from H.C. Starck (1.3 μm) were intensively mixed in a Turbula mixer with addition of balls for 60 minutes. The powder mixture formed will subsequently be referred to as "mechanical powder mixture".

Analytical monitoring indicated 59.94% by weight of Fe/24.80% by weight of Co/14.46% by weight of Mo/0.61% by weight of oxygen and 141 ppm of carbon. The particle size was measured as 1.88 μm (FSSS) and the specific surface area was measured as 0.78 $m^2/g$.

Figure 2:
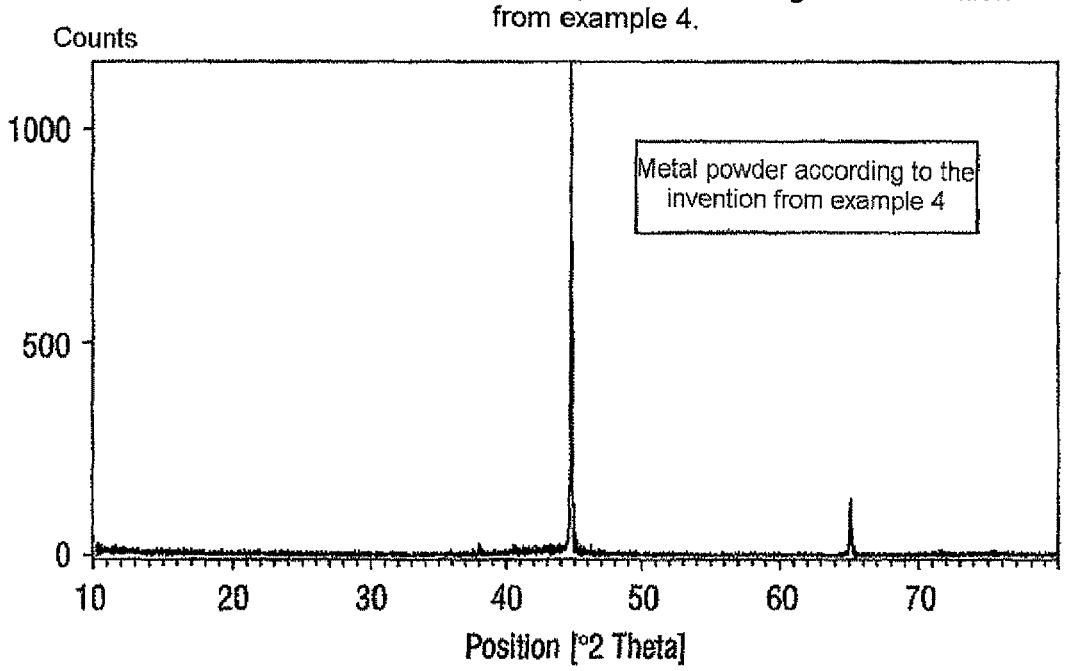
FIG. 2 shows an X-ray diffraction pattern of the powder according to the invention from example 4.
Figure 2:
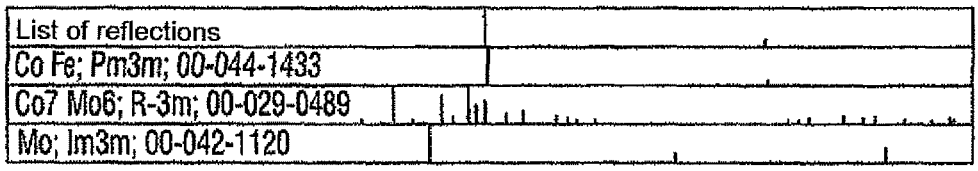

When compared, the powders from examples 4 and 5 display very different X-ray diffraction patterns. The mechanical powder mixture from example 5 displayed distinct, separated reflections for the components Fe, Co and Mo (see FIG. 1) which can virtually no longer be detected in the prealloyed powder according to the invention from example 4 (FIG. 2); obviously, the components Co and Mo are dissolved in the Fe matrix.

Figure 3:
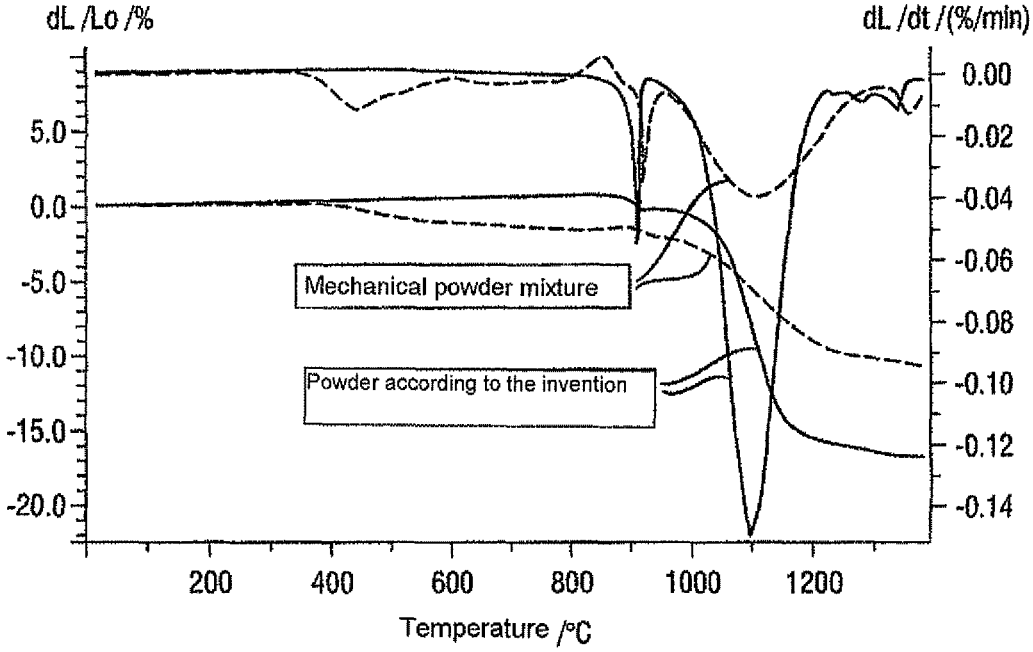
FIG. 3 compares the results of thermal dilatometric measurements during sintering of the mechanical powder mixture and the alloy powder according to the invention.

The different structure of the mechanical powder mixture and the powder according to the invention leads to different sintering behavior which shows up in the thermal dilatometric analysis, see FIG. 3. To carry out the test, green bodies were produced by cold isostatic pressing at 221 MPa and sintered under a hydrogen atmosphere in a 402 E dilatometer from Netzsch Gerätebau GmbH.

The mechanical powder mixture displayed a number of shrinkage steps (see length change rates—broken line) which make the sintering of dense and microstructure-optimized components more difficult. The powder according to the invention from example 4 shows, in addition to the α/γ phase transformation (transformation from the body-centered cubic crystal lattice into the face-centered cubic crystal lattice) of the FeCo matrix at about 900° C., only one very sharp shrinkage step in the range 1000-1200° C. The phase transformation proceeds with an increase in volume in the case of the mechanical powder mixture, but with a shrinkage in the case of the powder according to the invention.

Figure 4:
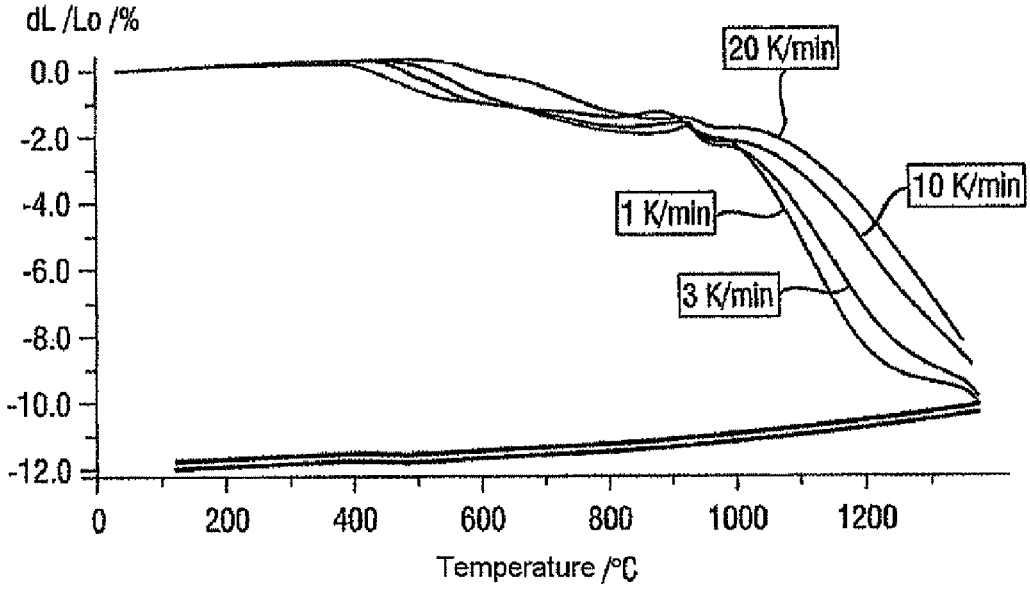
FIG. 4 shows the results of thermal dilatometric measurements during sintering of the mechanical powder mixture from example 5 as a function of the heating rate.
Figure 5:
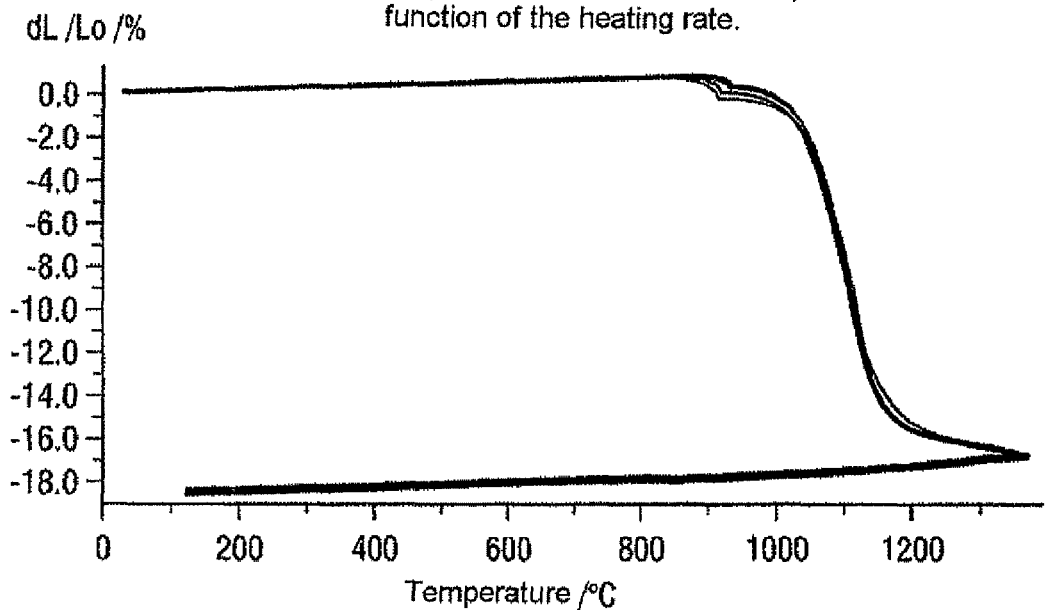
FIG. 5 shows the results of thermal dilatometric measurements during sintering of the alloy powder according to the invention from example 4 as a function of the heating rate.

The sintering behavior of the mechanical powder mixture from example 5 is dependent on the heating rate, see FIG. 4. Faster heating rates shift the shrinkage in the direction of higher temperatures. Surprisingly, the shrinkage of the powder according to the invention from example 4 is, in contrast, virtually independent of the heating rate, see FIG. 5.

Figure 6:
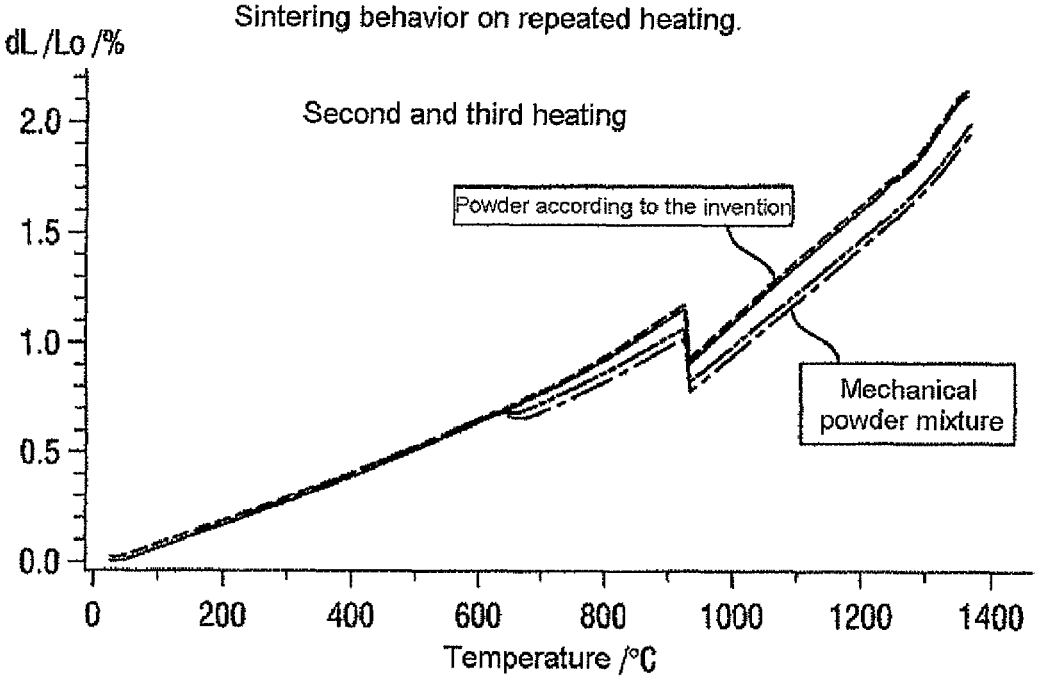
FIG. 6 compares the sintering behavior of the mechanical powder mixture from example 5 and the alloy powder according to the invention from example 4 on repeated heating.
Figure 7:
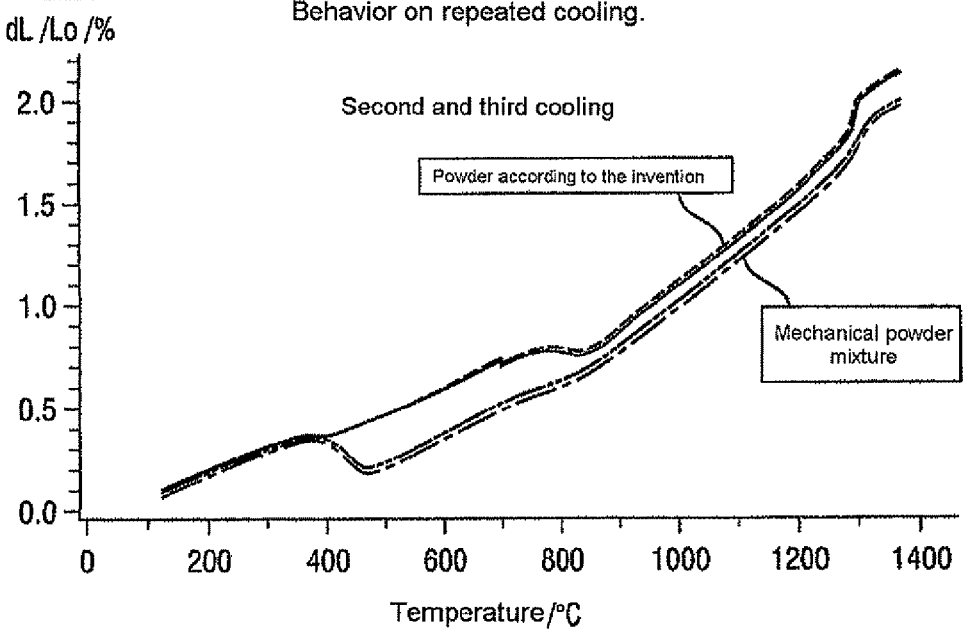
FIG. 7 compares the behavior on repeated cooling of the mechanical powder mixture from example 5 and the alloy powder according to the invention from example 4.

The different sintering behavior is also retained on repeated heating (FIG. 6) and cooling (FIG. 7), and is thus a reproducible property of the respective powders.

Figure 8:
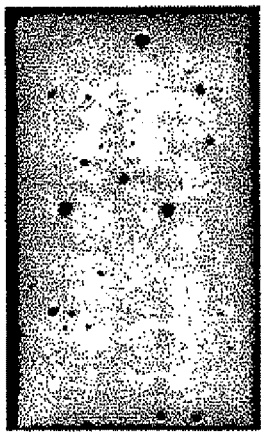
FIG. 8 compares the residual porosities of the sintered bodies produced from the mechanical powder mixture from example 5 and from the alloy powder according to the invention from example 4.
Figure 8:
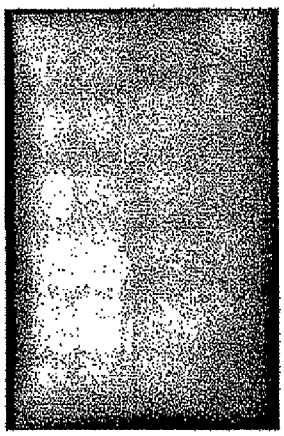

The sintered pellets from the dilatometric tests at different heating rates and a uniform cooling rate were examined to determine the sintered density, porosity and hardness. The results are shown in table 2. Surprisingly, the powder according to the invention displays, despite significantly lower green densities after pressing, systematically higher sintered densities with a correspondingly lower porosity and significantly higher hardnesses compared to the mechanical powder mixture from example 5. The residual porosity remaining after sintering for the mechanical powder mixture from example 5 and the powder according to the invention from example 4 is shown in FIG. 8 (in each case at a heating rate of 10 K/min).

TABLE 2

Sintered densities and hardnesses of the sintered specimens from thermal dilatometry

| Mechanical powder mixture from example 5 Theoretical density: 8.40 g/cm³ | | | | | Powder according to the invention from example 4 Theoretical density: 8.40 g/cm³ | | | |
|---|---|---|---|---|---|---|---|---|
| Green density at a pressing pressure of 221 MPa (g/cm³) | | % of the theor. density | | | Green density at a pressing pressure of 221 MPa (g/cm³) | | % of the theor. density | |
| 5.59 | | 66.2 | | | 4.6 | | 54.4 | |
| Heating rate K/min | Sintered density (g/cm³) | % of the theor. density | Hardness HRC | Standard dev. s | Sintered density (g/cm³) | % of the theor. density | Hardness HRC | Standard dev. s |
| 1 | 8.20 | 97.6 | 49.4 | 0.95 | 8.37 | 99.6 | 56.1 | 0.76 |
| 3 | 8.23 | 98.0 | 47.7 | 0.31 | 8.34 | 99.3 | 56.2 | 0.31 |
| 10 | 8.20 | 97.6 | 49.6 | 3.59 | 8.32 | 99.0 | 56.1 | 0.21 |
| 20 | 8.23 | 98.0 | 51.7 | 4.68 | 8.39 | 99.9 | 56.3 | 0.46 |

Sintering temperature: 1370° C., 60 min

Isothermal

Cooling rate: uniform 10 K/min

Examples 6, 7 and 8

Using a method analogous to examples 1 to 4, alloy powders were produced by the process described in example 1 via oxalate precipitation, calcination and reduction under hydrogen. Their compositions as shown in table 3 and all alloying elements are present in prealloyed form. The molybdenum content was introduced as molybdenum dioxide suspended in the salt solution during the oxalate precipitation.

The alloy powders "as produced" were subsequently pressed and sintered to produce rectangular bars.

The green bodies were produced by uniaxial pressing at a pressure of 374 MPa. Green densities of 5 g/cm$^3$ were achieved, corresponding to about 60% of the theoretical density.

Sintering was carried out under hydrogen in a continuous furnace; the total sintering time was 8 hours including preheating and cooling time. The sintering temperatures and results are shown in table 4.

TABLE 3

Table 3: Composition of the alloys produced

| Components (% by weight) | Example 6 | Example 7 | Example 8 |
|---|---|---|---|
| Fe | 43.06 | 75.91 | 76.02 |
| Co | 38.63 | 4.79 | 18.01 |
| Cu | 9.75 | 4.19 | |
| Mo | 7.29 | 5.26 | 5.18 |
| Ni | | 9.29 | |
| O | 0.35 | 0.43 | 0.48 |

TABLE 4

Table 4: Sintering temperatures and results

| Sample | Sintering temperature (° C.) | Sintered density (g/cm$^3$) | % of the theor. density | Porosity (%) |
|---|---|---|---|---|
| Example 6 | 1130 | 8.29 | 98.1 | 1.9 |
| Example 7 | 1180 | 7.91 | 97.5 | 2.5 |
| Example 8 | 1180 | 7.53 | 93.4 | 6.6 |

Figure 9:
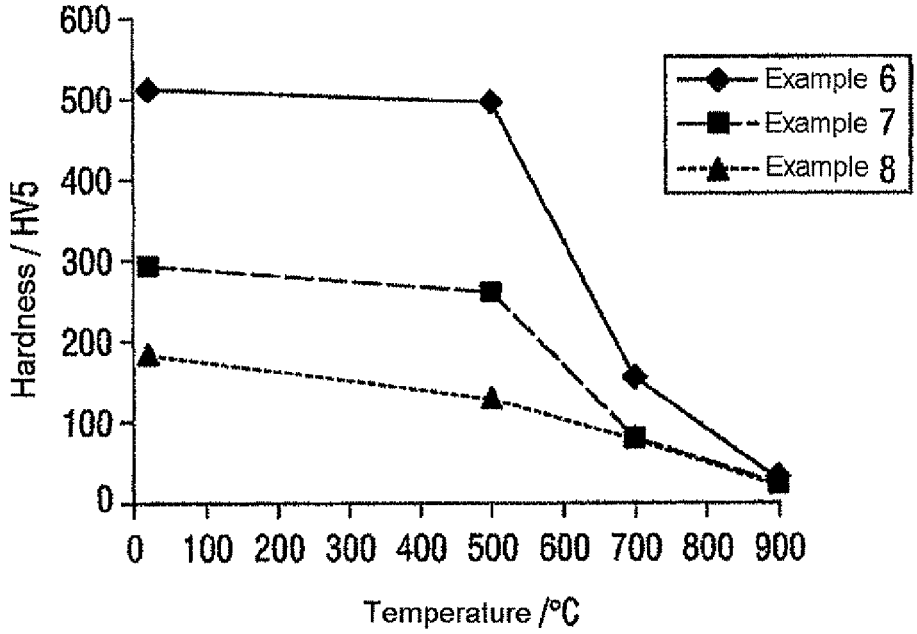
FIG. 9 compares the hot strengths of the alloy powders from examples 6, 7 and 8, with improved hot hardnesses being apparent at molybdenum contents of greater than 6 or 7% by weight.

To determine the hot hardnesses, bars having a width of about 8 mm were used. Testing of the hot hardnesses of the sintered bars was carried out by the Vickers hardness method HV5 (Vickers hardness under a load of kg) using a calibrated micro-macro-hardness testing system. Before the measurement, the surfaces of the specimens were ground flat and parallel and the measurement surface was polished. The hardnesses at 22° C. (room temperature), 500° C., 700° C. and 900° C. were determined. The hold time of the specimens at the specified temperatures was 10 min and the hold time during indentation was 20 seconds; five measurements were carried out in each case. Table 5 and FIG. 9 show the results obtained; s is the standard deviation. It can clearly be seen that materials having a molybdenum content of more than 6% by weight under the corresponding production and measurement conditions have significantly higher Vickers hardnesses HV5 in the temperature range from room temperature to 700° C.; the hardness of the specimen from example 6 is almost twice as high as the hardnesses of the specimens from examples 7 and 8 (159 in the case of example 6 compared to 84 and 82 in the case of examples 7 and 8).

TABLE 5

Hot hardnesses of the alloys

| Measurement | Example 6 | | Example 7 | | Example 8 | |
|---|---|---|---|---|---|---|
| temp. (° C.) | Hardness HV5 | s | Hardness HV5 | s | Hardness HV5 | s |
| 22 | 515 | 14 | 295 | 11 | 185 | 5 |
| 500 | 499 | 20 | 262 | 16 | 130 | 4 |
| 700 | 159 | 5 | 84 | 2 | 82 | 5 |
| 900 | 31 | 1 | 26 | 1 | 23 | 1 |

The invention claimed is:

1. A prealloyed metal powder containing the elements iron, cobalt and molybdenum wherein the X-ray diffraction pattern of said prealloyd metal powder has a reflection for $(FeCo)_7Mo_6$ at 2Theta=37.5° and having a carbon content of less than 0.02% by weight, and wherein the powder has a specific surface area determined by the BET method of greater than 0.5 m$^2$/g and a specific surface area determined by the BET method of greater than 0.5 m$^2$/g.

2. The prealloyed metal powder as claimed in claim 1, which comprises from 20% by weight to 90% by weight of iron, up to 65% by weight of cobalt and from 3% by weight to 60% by weight of molybdenum.

3. The prealloyed metal powder as claimed in claim 1, having an average particle size in accordance with ASTM B 330 of less than 8 μm.

4. The prealloyed metal powder as claimed in claim 1, containing up to 25% by weight of molybdenum and/or copper.

5. A prealloyed metal powder containing the elements iron, cobalt and molybdenum wherein the X-ray diffraction pattern of said prealloyd metal powder has a reflection for $(FeCo)_7Mo_6$ at 2Theta=37.5° and wherein the powder has a specific surface area determined by the BET method of greater than 0.5 m$^2$/g and containing from 6.5 to 10% by weight, of molybdenum and/or copper and a specific surface area determined by the BET method of greater than 0.5 m$^2$/g.

6. The prealloyed metal powder as claimed in claim 1, containing from 1% by weight to 10% by weight of nickel.

7. The prealloyed metal powder as claimed in claim 1, containing up to 3% by weight each of a metal selected from the group consisting of titanium, niobium, vanadium, tantalum, manganese and aluminum.

8. A component which comprises the prealloyed metal powder as claimed in claim 1.

9. A shaped article which can be is obtained by sintering a prealloyed metal powder as claimed in claim 1 wherein shaped article has been sintered and the sintered article has a density greater that 99% of the theoretical density.

* * * * *

UNITED STATES PATENT AND TRADEMARK OFFICE

CERTIFICATE OF CORRECTION

PATENT NO. : 8,133,297 B2
APPLICATION NO. : 12/517124
DATED : March 13, 2012
INVENTOR(S) : Bernd Mende et al.

It is certified that error appears in the above-identified patent and that said Letters Patent is hereby corrected as shown below:

In the Claims:

At column 14, claim number 1, line numbers 26-27, delete "and a specific surface area determined by the BET method of greater than 0.5 $m^2/g$".

At column 14, claim number 5, line numbers 44-45, delete "and a specific surface area determined by the BET method of greater than 0.5 $m^2/g$".

Signed and Sealed this
Fourteenth Day of August, 2012

David J. Kappos

David J. Kappos
*Director of the United States Patent and Trademark Office*